US007140706B2

(12) United States Patent
Nellen et al.

(10) Patent No.: US 7,140,706 B2
(45) Date of Patent: Nov. 28, 2006

(54) SYSTEM FOR ADJUSTING THE INCLINATION OF PRINT HEADS

(75) Inventors: Wilhelmus H. J. Nellen, Venlo (NL); Leonardus R. A. Willems, Swalmen (NL); Dirk Brouns, Born (NL)

(73) Assignee: OCE-Technologies B.V., Venlo (NL)

( * ) Notice: Subject to any disclaimer, the term of this patent is extended or adjusted under 35 U.S.C. 154(b) by 232 days.

(21) Appl. No.: 10/770,509

(22) Filed: Feb. 4, 2004

(65) Prior Publication Data

US 2004/0155914 A1 Aug. 12, 2004

(30) Foreign Application Priority Data

Feb. 5, 2003 (EP) ..... 03075380

(51) Int. Cl.
*B41J 25/308* (2006.01)

(52) U.S. Cl. ..... 347/8

(58) Field of Classification Search ..... 347/8, 347/37

See application file for complete search history.

(56) References Cited

U.S. PATENT DOCUMENTS 6,575,557 B1 * 6/2003 Tominaga ..... 347/37
6,626,511 B1 * 9/2003 Riou ..... 347/8
2002/0024554 A1 2/2002 Tominaga

FOREIGN PATENT DOCUMENTS

EP 0 824 074 A2 2/1998

* cited by examiner

*Primary Examiner*—Vip Patel
*Assistant Examiner*—Brian J. Goldberg
(74) *Attorney, Agent, or Firm*—Birch, Stewart, Kolasch & Birch, LLP

(57) ABSTRACT

A system for adjusting the angular orientation in a first plane of a plurality of print head cartridges or groups of cartridges arranged adjacent to each other on a carriage which can be reciprocated in a Y-direction, wherein each of said cartridges or group of cartridges is mounted on said carriage to be tiltable in said first vertical plane, wherein for each of said cartridges or groups of cartridges said carriage is provided with first adjustors for adjusting the angular orientation of the respective cartridge or group of cartridges, said system being provided with second adjustors arranged remote from said carriage for adjusting said angular orientation of said cartridge or group of cartridges, said second adjustors selectively, operatively communicating with said first adjustors of a selected one of said cartridges or group of cartridges.

18 Claims, 3 Drawing Sheets

SYSTEM FOR ADJUSTING THE INCLINATION OF PRINT HEADS

BACKGROUND OF THE INVENTION

This non-provisional application claims priority under 35 U.S.C. § 119(a) on Patent Application No. 03075380.0 filed in Europe on Feb. 5, 2003, which is herein incorporated by reference.

FIELD OF THE INVENTION

The present invention relates to a system for adjusting the angular orientation of print head cartridges arranged on a carriage of a printer, such as a laser jet printer or an inkjet printer.

RELATED ART

Print head cartridges are usually arranged on a carriage that is reciprocated in the so-called Y-direction over the width of the surface that is to be printed. The carriage is provided with means for receiving and holding the cartridge with the print head nozzles directed towards said surface. During printing, the surface to be printed, such as a paper web, is moved in the X-direction, which is perpendicular to the Y-direction.

Nowadays high-resolution printing processes require a high accuracy in the position of the print head nozzles with respect to the paper. It may therefore be desirable to be able to compensate for possible misalignment of the print head nozzles with the imaginary X-lines and/or Y-lines of the input image template or grid to adjust the position of the print head nozzles in the X- and Y-direction with respect to the carriage.

It has been suggested to adjust the position of print head nozzles in the X-direction of one print head of a pair by using a cam-lever mechanism arranged on the carriage. A stationary lever arm can be operated to extend into the path of the cam-lever to rotate the cam-lever about a Z-axis extending perpendicular to the paper. The cam on the cam-lever is then urged against the print head cartridge so that the cartridge is tilted about an axis parallel to the Y-direction. This known adjusting mechanism with two levers is quite complex and occupies much space, in particular the cam-lever which projects from the carriage in the X-direction. In addition, due to its constructional width, the known adjusting mechanism cannot properly be arranged on the carriage for two adjacent print heads. In any event, arranging a plurality of such adjusting mechanisms on carriages carrying a plurality of print heads would increase the weight of the carriage in an unacceptable manner.

SUMMARY OF THE INVENTION

The present invention provides an adjusting mechanism for print heads on a carriage of a printer whereby the weight of the carriage is increased to a limited degree only, even in the case of a plurality of print heads.

The present invention further provides an adjusting mechanism for print heads on a carriage of a printer that functions with a high degree of accuracy and with which the position of the print head nozzles in the X-direction can be fine-tuned.

From one aspect, the present invention provides a system for adjusting the angular orientation in a first plane perpendicular to the X-direction of a plurality of print head cartridges or groups of cartridges arranged adjacent to each other on a carriage which can be reciprocated in the Y-direction. Each of the cartridges or group of cartridges is mounted on the carriage to be tiltable in said first vertical plane, wherein for each of said cartridges or groups of cartridges, said carriage is provided with a first means for adjusting the angular orientation of the respective cartridge or group of cartridges, said system being provided with a second means arranged remote from said carriage for adjusting the angular orientation of said cartridge or group of cartridges, said second adjusting means being arranged to be selectively, operatively coupled with said first adjusting means of a selected one of said cartridges or group of cartridges.

The division of the adjusting mechanism into first adjusting means on every cartridge or group of cartridges of a plurality of cartridges or groups of cartridges on the carriage and second adjusting means positioned remote from the carriage and which can be selectively operatively coupled with a selected first adjusting means, makes it possible to keep the construction of the adjusting means on the carriage simple and requires only one second adjusting means for all first adjusting means.

By selectively coupling the selected first adjusting means and the second adjusting means, the adjusting means can be operated positively and therefore in a controlled manner, permitting a fine-tuning of the relative position of the cartridges, in particular their nozzles, in the X-direction. In addition, the weight of the carriage will not be increased to too high a degree.

In a further development, the second adjustment means are pivotable in a plane perpendicular to the Y-direction between a retracted position and a coupled position, so that the space occupied by the movement and presence of the second adjustment means may be maintained within limits. Advantageously, the second adjustment means may then be movable towards the coupled position in a direction towards the nozzle side of the cartridge. In this way, the path of movement of the second adjustment means is maintained within the usual boundaries of the printer.

In a further development, each one of said cartridges or group of cartridges is provided with said first adjusting means, so that an optimal adjustability is realised, with only one second adjusting means.

The second adjusting means can be arranged at one end of the path of reciprocal movement of said carriage. In an advantageous manner, the second adjusting means may then be arranged in a print head cleaning unit, so that the space already occupied by the cleaning unit is used more efficiently.

In a further development, the first adjusting means are adapted for tilting said cartridge by being moved in said first plane, so that the space occupied in the Y-direction is maintained within limits. The heads can be placed closer to each other.

The first adjusting means may then be adapted for tilting said cartridge by being moved substantially vertically, that is, perpendicular to the paper web to be printed, whereby the space in the horizontal directions is kept within limits.

Advantageously, the first adjusting means are adapted for tilting said cartridge by being moved according to a substantially linear path, so that as little space as possible is required.

In a constructionally simple and reliably operating embodiment, the first adjusting means comprise a first stop surface on said cartridge and a movable wedge-shaped second stop surface in contact therewith.

In a further development, the first and second adjusting means comprise first and second cooperating coupling means and means for bringing the first and second coupling means into and out of operative engagement with each other. Thus, the first adjusting means may comprise a spindle forming a rotational unity with the first coupling means, the first and second coupling means having matching unrounded cross-sections. In this way, a quick and reliable coupling can be established.

The process of coupling can be improved when the second coupling means forms a male part, and, even more, when the male part is provided with a pilot surface.

In a further development the first and second coupling means have hexagonal cross-sections for improving the rotational engagement between the male and female parts.

Advantageously, the system according to the present invention further comprises means for adjusting the position of the second adjustment means in the X-direction, so that deviations in position in the X-direction of the first adjusting means (for instance due to a different size of the cartridge or staggered placement of the cartridges) can be compensated for.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
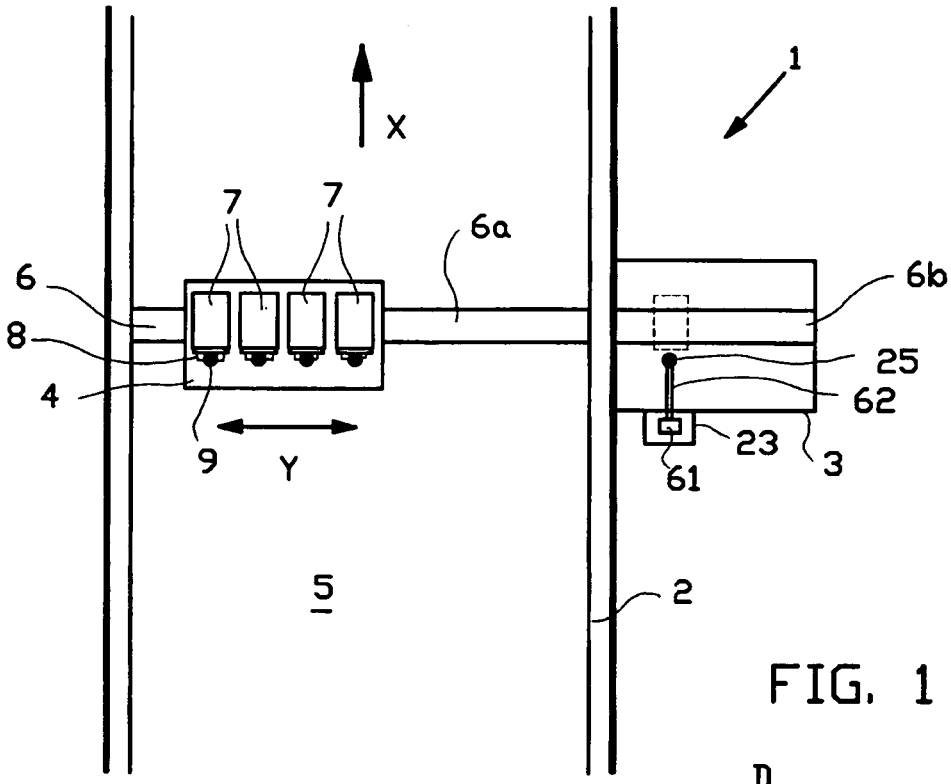
FIG. 1 schematically shows a top view of a printer carriage of a printer disposed above a paper web.

In the top view of FIG. 1, a printing station 1 is shown, arranged over and aside of a support 2 for a paper web 5 which is moved in the direction X, which may be a horizontal direction. The printing station 1 comprises a guide 6 for a carriage 4 on which a plurality of cartridges or print heads 7 are supported and which is movable in the direction Y, which may also be horizontal.

A cleaning station 3 is arranged adjacent to the support 2. The cleaning station is arranged below the guide extension 6*b*, which is aligned with the guide portion 6*a* which is positioned over the support 2.

Figure 4:
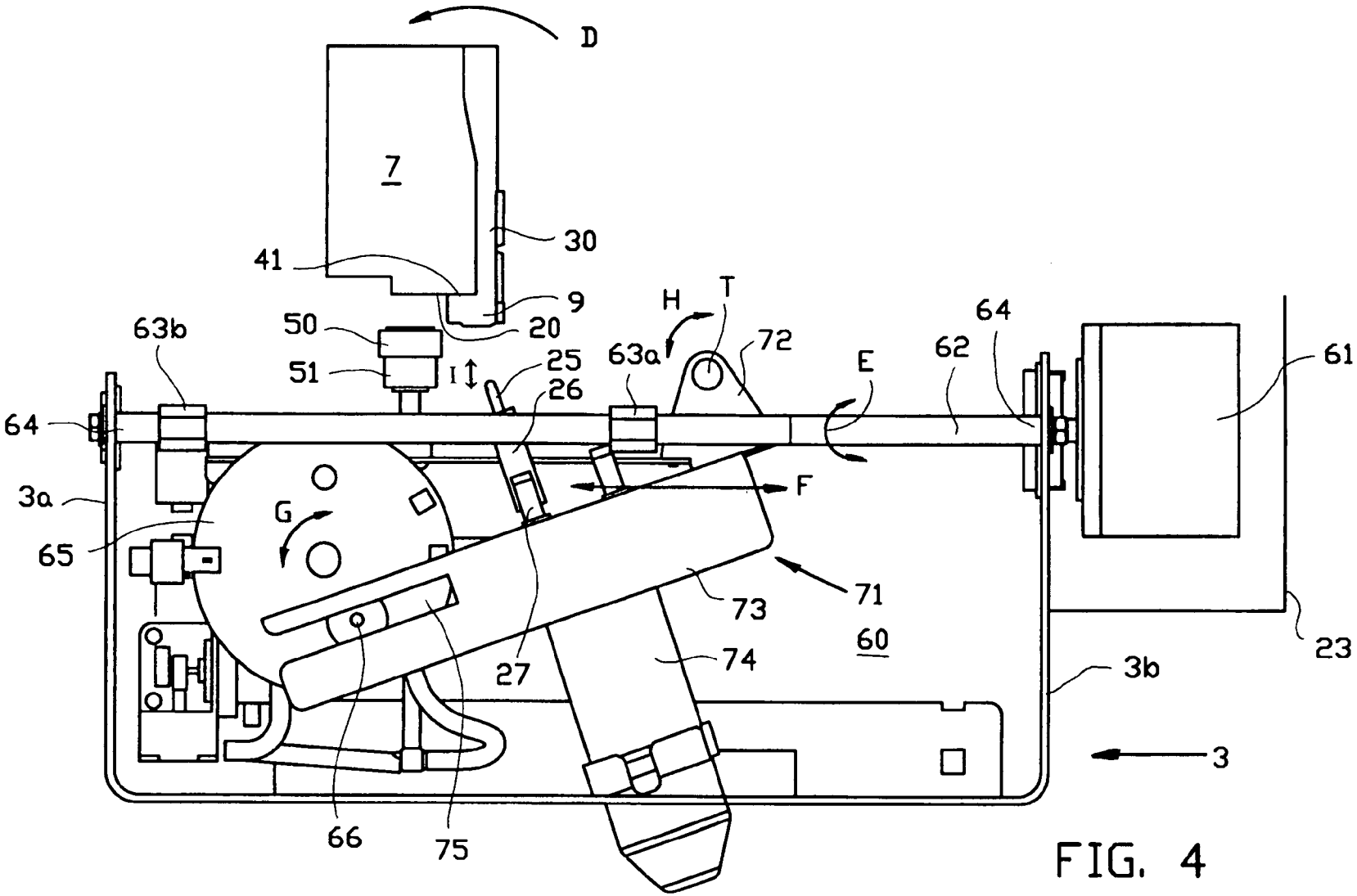
FIG. 4 is a schematic side view of a system according to the present invention.

As has been schematically shown in FIG. 4, the cleaning station 3 has a cleaning head 50 arranged on top of a vertical bar 51 which is movable up and down in the direction I by operating means that are not further shown.

All print heads 7 are indirectly supported in frames 30 which are fixedly mounted on the carriage 4 and support sub-frames 40 onto which the print heads 7 are mounted. The sub-frames 40 are tiltable in the direction D about an axis S parallel to the Y direction with respect to the frames 30.

Figure 2:
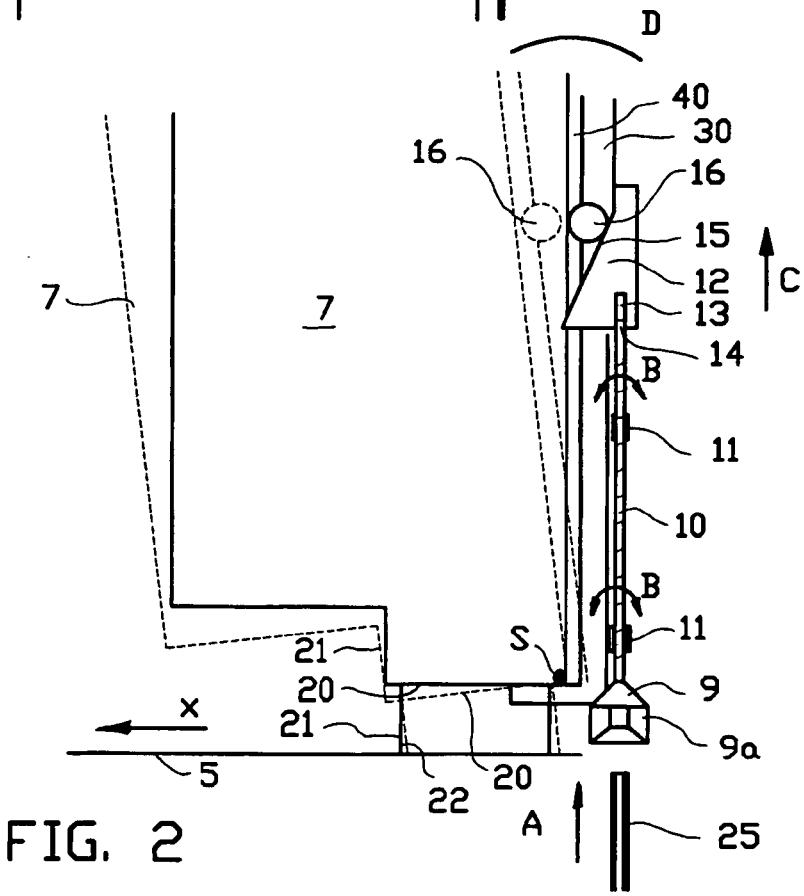
FIG. 2 schematically shows a side view of a cartridge adjustment arrangement according to the present invention.

This tilting movement is more clearly shown in FIG. 2, where a print head 7 is schematically depicted in two orientations, namely a standard, vertical orientation, shown in full lines and a tilted orientation, shown in broken lines. At its lower side, the print head is provided with a nozzle plate 20 having nozzles which, when activated, discharge ink in the Z-directions.

The frame 30 supports a linearly, vertical shiftable wedge 12, which has an inclined wedge plane 15 and a threaded hole 13. A top end 14 of a spindle 10 is threadedly received in hole 13 and is rotatably guided in bearings 11 on frame 30, see also FIG. 3B. At the lower end of the spindle 10 a hexagonal socket 9 is fixed, in which the upper end of a hexagonal rod 25, which defines a male with a pilot surface, is insertable when displaced upwards in the direction A. This insertion is improved by pilot faces 9*a*.

The sub-frame 40 is provided with a horizontally extending bar 16 which is in engagement with wedge face 15.

Figure 3A:
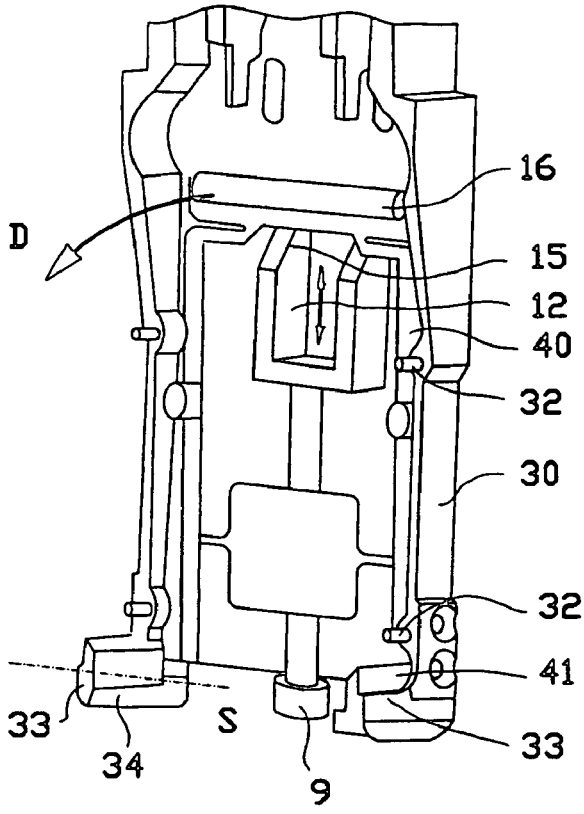
FIGS. 3A and 3B are views in perspective of opposite sides of a holder for a cartridge in a system according to the present invention.
Figure 3B:
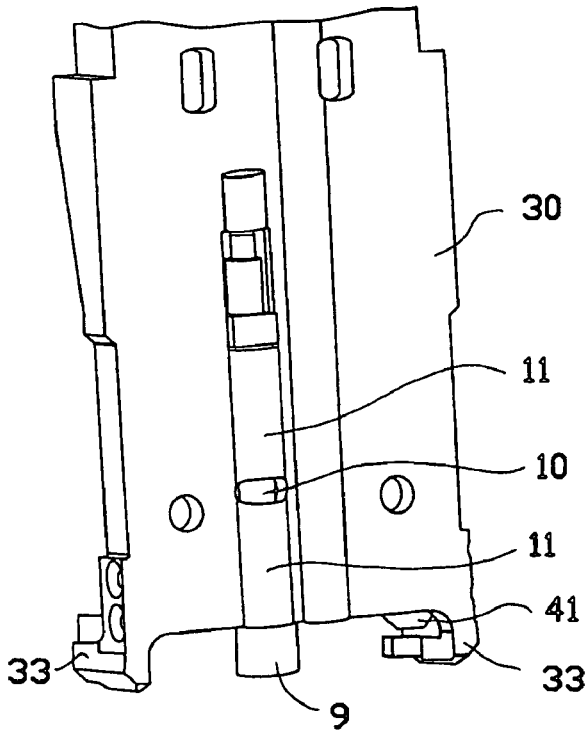

As can be seen in FIG. 3A, the sub-frame 40 is accommodated in frame 30 which has two horizontal legs 41 which serve as support for a print head which is not shown. The sub-frame 40 is provided with 2 stops on extending bar 16 for defining the standard orientation of the print head. The sub-frame 40 can be tilted around axes S and the sub-frame 40 together with the head and moves in the direction D.

In the cross-section of the cleaning unit 3 shown in FIG. 4, the walls 3*a–b* define a housing 60 in which the cleaning head 50 and the operative means therefor, as well as an adjusting mechanism for the movement of the hexagonal rod 25 are accommodated. This mechanism includes a motor 61 accommodated in housing 23 which drives a shaft 62 supported in bearings 64 arranged in walls 3*a,b* of the housing 60. When activated, the motor 61 rotates the shaft 62 in the directions E, the cams 63*a,b* being displaced in the linear directions F. Cam 63*a* is connected to bracket 72 of a sub-frame 71, which bracket is rotatable about axis T in the directions H. The sub-frame 71 comprises an L-strip 73 which is provided with a slot 75 in which a cam 66 mounted on a wheel 65 is slidingly received. The wheel 65 is rotatable in the directions G by a motor which is not shown.

The sub-frame 71 carries a motor 74 for driving a shaft 26 carrying hexagonal rod 25. The shaft 26 is supported on a spring 27 for biasing the outer end of the rod 25 upwards during engagement of the pilot faces 9*a* of the socket 9.

In or before operation, the print heads 7 may be moved by the carriage 4 towards the cleaning unit 60. When it has been established that one, some or all of the print heads need to be adjusted in their orientation in the X-direction, the carriage 4 is driven to properly position the frame 30 of the print head 7 in question. Then the motor for the wheel 65 is activated, so that the cam 66 moves and thus the slot 75 and consequently the sub-frame 73 is rotated upwards in the direction H about axis T so that the upper end of rod 25 moves upwards (A) and operatively and matingly engages socket 9 on the frame 30 in question. Then motor 74 is activated so as to rotate rod 25 and therewith spindle 10 in the direction B. As a result, the upper end 14 will rotate within threaded hole 13, whereby the wedge 12 will move upwards or downwards in the direction C. Consequently, the bar 16 will be urged sidewards away from the frame 30 or under the influence of biasing means arranged between the frames 30 and 40 but not shown move back to the desired extent.

By way of example, and referring to FIG. 2, the sub-frame 40 and therewith the print head 7 can be tilted in the direction D about fulcrum S so that the nozzles 21 change their orientation from, by way of example, a vertical discharging orientation to a more slanting orientation. This results in an X-displacement of the ejected inkdots on the receiving medium 5. The desired degree of rotation is determined by control means which are not shown and which operate the adjusting mechanism in response to measurements on the printing results.

When the adjustment operation for one print head has been completed, the same operation can be repeated for another one of the print heads, if so desired.

In case the print heads are replaced by print heads of different dimensions, the location of the rod 25 may be adapted by activating motor 61 to move the bracket 72 in the direction F to a position in which the path of movement of the upper end of rod 25 will coincide with socket 9.

What is claimed is:

1. A system for adjusting an angular orientation in a first plane of a plurality of print head cartridges or groups of print head cartridges arranged adjacent to each other on a carriage which can be reciprocated in a Y-direction, wherein each of said print head cartridges or groups of print head cartridges is mounted on said carriage to be tiltable in a first vertical plane perpendicular on the Y-direction, wherein for each of said cartridges or groups of cartridges said carriage is provided with first adjustors for adjusting the angular orientation of the respective print head cartridge or groups of print head cartridges, said system being provided with second adjustors arranged remote from said carriage for adjusting said angular orientation of said print head cartridge or groups of print head cartridges, said second adjustors selectively, operatively coupled with said first adjustors of a selected one of said print head cartridges or groups of print head cartridges.

2. The system according to claim 1, wherein each one of said cartridges or groups of cartridges is provided with said first adjustors.

3. The system according to claim 1, wherein said first adjustors are adapted for tilting said cartridge by being moved in a substantially linear path.

4. The system according to claim 1, further comprising means for adjusting the position of said second adjustors in the Y-direction.

5. The system according to claim 1, wherein the system is being part of an inkjet printer.

6. The system according to claim 1, wherein the second adjustors are pivotable in a plane perpendicular to the Y-direction between a retracted position and a coupled position.

7. The system according to claim 6, wherein the second adjustors are movable towards the coupled position in a direction towards a nozzle side of the cartridge.

8. The system according to claim 1, wherein said second adjustors are arranged at one end of a path of reciprocal movement of said carriage.

9. The system according to claim 8, wherein said second adjustors are arranged in a print head cleaning unit.

10. The system according to claim 1, wherein said first adjustors are adapted for tilting said cartridge by being moved in said first vertical plane.

11. The system according to claim 10, wherein said first adjustors are adapted for tilting said cartridge by being moved substantially vertically, that is perpendicular to a paper web to be printed.

12. The system according to claim 10, wherein said first adjustors comprise a first stop surface on said cartridge and a movable wedge-shaped second stop surface in contact with said first stop surface.

13. The system according to claim 1, wherein said first and said second adjustors comprise first and second cooperating coupling means and means for bringing the first and second coupling means into and out of operative engagement with each other.

14. The system according to claim 13, wherein the second coupling means form a male part.

15. The system according to claim 14, wherein the male part is provided with a pilot surface.

16. The system according to claim 13, wherein said first adjustors comprise a spindle forming a rotational unity with said first coupling means, said first and said second coupling means having matching, not rounded cross-sections.

17. The system according to claim 16, wherein said first and second coupling means have hexagonal cross-sections.

18. The system according to claim 16, wherein said second coupling means are rotatable.

* * * * *